United States Patent [19]

Emoto et al.

[11] 3,981,732

[45] Sept. 21, 1976

[54] GRANULAR p-PHENYLENEDIAMINE COLOR DEVELOPING AGENT

[75] Inventors: Takeo Emoto, Fujisawa; Satoshi Kurihara, Hiratsuka, both of Japan

[73] Assignee: Fuji Photo Film Co., Ltd., Minami-ashigara, Japan

[22] Filed: Apr. 9, 1974

[21] Appl. No.: 459,446

Related U.S. Application Data

[62] Division of Ser. No. 281,672, Aug. 18, 1972, Pat. No. 3,833,377.

[30] Foreign Application Priority Data

Aug. 19, 1971 Japan ..... 46-63231

[52] U.S. Cl. ..... 96/66.2; 96/55

[51] Int. Cl.[2] ..... G03C 5/30; G03C 7/00

[58] Field of Search ..... 96/66 R, 66.2, 97, 55; 260/578; 23/293 A, 313; 264/141, 143

[56] References Cited

UNITED STATES PATENTS

| | | | |
|---|---|---|---|
| 2,596,978 | 5/1952 | Bortner et al. | 96/66.2 |
| 2,850,764 | 9/1958 | Evans et al. | 264/143 |
| 3,297,760 | 1/1967 | von Hessert et al. | 96/66 R |
| 3,645,911 | 2/1972 | van Besauw et al. | 96/97 |
| 3,833,377 | 9/1974 | Emoto et al. | 96/66.2 |

*Primary Examiner*—David Klein
*Assistant Examiner*—Richard L. Schilling
*Attorney, Agent, or Firm*—Sughrue, Rothwell, Mion, Zinn and Macpeak

[57] ABSTRACT

A process for preparing a granular color developing agent, which comprises kneading a mixture of at least one excipient selected from the group consisting of water and lower alcohols and a p-phenylenediamine color developing agent, and granulating the mixture is disclosed.

5 Claims, No Drawings

GRANULAR P-PHENYLENEDIAMINE COLOR DEVELOPING AGENT

This is a division of application Ser. No. 281,672 filed Aug. 18, 1972, and now U.S. Pat. No. 3,833,377.

BACKGROUND OF THE INVENTION

1. Field of the Invention

The present invention relates to a process for formulating p-phenylenediamine color developing agents into granular form, these developing agents being used as a color developing agent for natural-color photography (or color photography).

2. Description of the Prior Art p-Phenylenediamine color developing agents are known in the art, and may be used either in their free form or in their salt form. For example, some of the compounds are described in U.S. Pat. No. 2,193,015 (1940) and 2,108,243 (1938); British Pat. No. 778,437 (1957); J. Am. Chem. Soc., Vol. 73, pp 3100 – 3125 (1951), etc. More specifically, 4-amino-3-methyl-N-ethyl-N-[(beta-methanesulfonamido)-ethyl]aniline sesquisulfate monohydrate, 4-amino-N,N-diethylaniline monosulfate monohydrate, 4-amino-N-ethyl-N-(beta-hydroxyethyl)aniline monosulfate, 4-amino-N-ethylaniline monosulfate, 4-amino-3-methyl-N-ethyl-N-(beta-hydroxyethyl)aniline monosulfate, 4-amino-N-ethyl-N-(beta-methylsulfonamidoethyl)aniline monosulfate, and the like are examples of these developing agents.

These p-phenylenediamine color developing agents (hereinafter referred to as merely "color developing agent") have heretofore been marketed as fine powders. However, they are so light that they tend to scatter and, in addition, they will cause medicinal dermatitis (poisoning) on the parts of a body contacting them due to their toxicity (mainly dermatitis problems). In addition, some of these color developing agents become difficult to handle due to the solidification during storage even though, when they were produced, they were powders tending to scatter.

This tendency to solidify is increased by a slight amount of ambient moisture, and the smaller the size of the powders, the more easily the powders solidify in a short time due to their larger contact area.

In addition, since such powders are high in adhesive properties to each other, the powders flow poorly. Although powders from which this slight amount of water has been completely removed show good fluidity for a short time, this property will disappear within several hours in extreme cases. Therefore, the packaging process therefor requires a great deal of time.

SUMMARY OF THE INVENTION

As a result of extensive investigations on improving the above-described defects of these color developing agents, a process of admixing the color developing agent with at least one or more excipients comprising alcohols or water, formulating the mixture into granular form, then drying has been developed. In order to increase the hardness of the granular product, or during the processing necessary to formulate the color developing agents which tend to scatter into granules, the color developing agent is formulated into granules while binding the fine powder thereof by adding a water-soluble binder such as celluloses thereto to thereby successfully provide the product with novel characteristics not possessed by conventional powdery products.

DETAILED DESCRIPTION OF THE INVENTION

The procedures of practicing the present invention will be described in greater detail below.

The proportion of excipients can be varied depending upon the kind of color developing agent and the conditions of the powder thereof, but, in general, from 0.2 to 1.3 Kg of excipients per 10 Kg of the color developing agent are preferably used. Suitable excipients such as water or lower alcohols having a boiling point of lower than 100°C, such as methyl alcohol, ethyl alcohol, isopropyl alcohol, etc. are preferably employed. Higher alcohols are not preferred, because they require a long drying time due to their high boiling point during which the qualities of the color developing agents tend to be degraded, and because of their bad smell or poor working properties due to the solidifying characteristics of some of them.

When the color developing agent is in the form of a dried powder, a mixed solution of water and methyl alcohol or 50% (w/w) in concentration generally in an amount of from 0.6 to 1.1 Kg per 10 Kg of the color developing agent, a mixed solution of water and isopropyl alcohol of 50% (w/w, hereinafter concentrations are in w/w) in an amount of from 0.5 to 1.0 Kg, a mixed solution of water and ethyl alcohol in an amount of from 0.4 to 1.0 Kg, isopropyl alcohol alone in an amount of from 0.4 to 1.2 Kg or water alone in an amount of from 0.3 to 0.6 Kg, per 10 Kg of the color developing agent is used as an excipient. The addition of the excipient is preferably conducted incrementally since a large addition of excipient makes the kneaded product paste-like, which requires a long time in drying. When powders having an extremely large tendency to scatter are used, or when an increase in the hardness of the granulated product is desired, from 50 to 100 g of an alkyl cellulose such as methyl cellulose, ethyl cellulose or propyl cellulose per 10 Kg of the color developing agent is added together with the excipient and, after kneading sufficiently, the kneaded mixture is extruded in the form of a rod, and then dried at an appropriate temperature. Where the color developing agent is a wet product containing water and alcohol, the proportion of the excipients can be determined by previously measuring the reduction in weight on drying (the reduction in weight should be preferably less than 10% and, if above 10%, drying or processing should be conducted), and subtracting the reduction in weight. Then kneading and granulating are conducted in the same manner as with dried powders, and subsequently, drying is conducted. In general, the mixing and kneading work are preferably conducted using a kneader, and the extrusion is conveniently conducted using a screw extruder, etc. Preferably, a fluidized layer drier is used for drying.

The granular product of the color developing agent thus granulated and dried shows increased solubility in water due to the porous structure provided thereto, and, in a dry condition, the shape thereof by the usual vibration and shock in packaging, transport, etc., is not easily lost and now powdery dust is produced. Thus, in many cases, the problems previously encountered with medicinal dermatitis never occur. In addition, the smaller surface area in comparison with the finely powdered products serves to prevent air-oxidation, and hence coloring with the lapse of time has been reduced.

At the same time, the adhesion of the granules to each other disappears, and therefore the formation of material masses, which were produced in the case of a powdered product, is enormously reduced. Thus, the granular product can be weighed out with a measuring spoon or a measuring cup, which markedly shortens the packaging and processing time and serves to improve the working property.

The physical properties of the granular product of the color developing agent prepared in accordance with the process of the invention were measured as follows.

Crushing weight: One particle of a color developing agent formulated into granules is removed, and a load is applied thereto to measure the weight on crushing.

Solidifying property with the lapse of time: 100 grams of a granulated product is left in a closed glass bottle for 3 months.

Moistening property: After leaving a sample for 3 days in an atmosphere saturated with water vapor at room temperature, the amount of water absorbed is measured.

Oxidizability: A granulated product and a powdered product were left in an atmosphere for 2 months, and the degree of discoloration was observed for a comparison of oxidizability.

Solubility: 1 gram of each of a powdery product and a granulated product was weighed out and the time required to dissolve it in 10 ml of water at room temperature was measured for comparison.

The present invention will be described in greater detail hereinafter by reference to the following Examples.

EXAMPLE 1

800 of a mixed solution of water and methanol of a concentration of 50% was sprayed over 10 Kg of dried powdery material of 4-amino-3-methyl-N-[(beta-methanesulfonamido)ethyl]aniline sesquisulfate monohydrate, $NH_2C_6H_3.N(C_2H_5)(CH_2)_2NHSO_2CH_3.3/2H_2SO_4.H_2O$, prepared according to the process described in J. Am. Chem. Soc., Vol. 73, pp 3100 – 3125 (1951) while kneading in a kneader, and the resulting mixture was kneaded for 15 minutes at room temperature. The resulting cake thus kneaded was subjected to a screw extrusion to mold it into a rod of 1.0 – 1.5 mm in diameter. Then, the resulting rod was dried using a hot air fluidized bed drier at a temperature below 80°C, and the granules formed which passed through a 1680$\mu$ sieve and did not pass through a 250$\mu$ sieve were collected to obtain 9.9 Kg of the granules. The resulting granulated product had a crushing weight of 150 g and was not crushed by usual vibrations and shock. Therefore, no dust was formed.

EXAMPLE 2

400 ml of a mixed solution of water and ethyl alcohol of a concentration of 50% was sprayed over 10 Kg of the wet powder of the color developing agent prepared according to the process described in Example 1 and containing a mixture of water and ethyl alcohol whose reduction in weight on drying was 4%, while kneading in a kneader. After kneading for 15 minutes, the mixture was subjected to screw extrusion to mold it into a rod of 1.0 – 1.5 mm in diameter, and 9.5 Kg of the granulated product was obtained in the same manner as described in Example 1. Crushing weight: 140 g; Solubility: 120 seconds (before granulation), 60 seconds (after granulation); Solidifying property: the granulated product did not solidify after 3 months; Oxidizability: the granulated product did not discolor.

EXAMPLE 3

50 grams of methyl cellulose was added to a dried material of the color developing agent prepared according to the process described in Example 1 while kneading in a kneader, and 300 g of water was sprayed over the mixture. After kneading the mixture for 15 minutes at room temperature, the mixture was subjected to screw extrusion to mold it into a rod of 0.5 – 1.0 mm in diameter, and 9.5 Kg of the granulated product was obtained in the same manner as described in Example 1. Crushing weight: 230 g. Addition of methyl cellulose increased the crushing weight by a factor of about 2. Solubility in water: 40 seconds; Solidifying property: the granulated product did not solidify after 3 months. Oxidizability: the granulated product did not discolor.

EXAMPLE 4

500 grams of isopropyl alcohol was sprayed over 10 Kg of the wet powder of the color developing agent having a reduction in weight on drying of 4% prepared according to the process described in Example 1 while kneading in a kneader. After kneading the mixture for 15 minutes at room temperature, the mixture was subjected to screw extrusion to mold it into a rod of 1.0 mm in diameter. Then, 9.3 Kg of the granulated product was obtained in the same manner as described in Example 1. Crushing weight: 120 g; Solubility: 120 seconds (before granulation), 60 seconds (after granulation); Solidifying property with the lapse of time: the granulated product did not solidify after 3 months; Oxidizability: the granulated product did not discolor.

EXAMPLE 5

900 ml of a mixed solution of water and isopropyl alcohol of a concentration of 50% was sprayed over 10 Kg of the dried powdery material of 4-amino-N,N-diethylaniline monosulfate monohydrate,

| | Before Granulation | | After Granulation | |
|---|---|---|---|---|
| Solubility | Dissolved in 120 sec. | | Dissolved in 60 sec. | |
| Solidifying Property with the Lapse of Time | Solidified in one day | | Not solidified after 3 months | |
| Oxidizability | Discolored to reddish-brown | | Remained white without discoloration | |
| Moistening Property | Before Leaving | After Leaving | Before Leaving | After Leaving |
| | 3.96% | 4.57% | 3.96% | 4.19% |

$NH_2C_6H_4N(C_2H_5)_2.H_2SO_4.H_2O$, prepared according to the process described in British Pat. No. 778,437 (1957) while kneading in a kneader, and the mixture was kneaded for 15 minutes at room temperature. The resulting cake was subjected to extrusion to mold it into a rod and granulated in the same manner as described in Example 1 to obtain 9.8 Kg of the granulated product.

| | Before Granulation | | After Granulation | |
|---|---|---|---|---|
| Solubility | 60 sec. | | 50 sec. | |
| Solidifying Property with the Lapse of Time | Solidified in 10 hours | | Not solidified after 3 months | |
| Oxidizability | Discolored to reddish-brown | | Remained white without discoloration | |
| Moistening Property | Before Leaving | After Leaving | Before Leaving | After Leaving |
| | 2.4% | 12.5% | 3.1% | 11.8% |
| Crushing Weight | | | 130 g | |

EXAMPLE 6

10 Kg of the dried product of 4-amino-N-ethyl-N-(beta-hydroxyethyl)aniline monosulfate, $NH_2C_6H_4N(C_2H_5)_2OH.H_2SO_4$, prepared according to the process described in U.S. Pat. No. 2,108,243 was granulated in the same way as described in Example 5 to obtain 9.6 Kg of the granulated product.

| | Before Granulation | | After Granulation | |
|---|---|---|---|---|
| Solubility | 60 sec. | | 40 sec. | |
| Solidifying Property with the Lapse of Time | Solidified in 10 days | | Not solidified after 3 months | |
| Oxidizability | Discolored to reddish-brown | | Remained white without discoloration | |
| Moistening Property | Before Leaving | After Leaving | Before Leaving | After Leaving |
| | 2.0% | 7.0% | 2.5% | 6.0% |
| Crushing Weight | | | 120 g | |

EXAMPLE 7

10 Kg of the dried powdery product of 4-amino-N-ethylaniline monosulfate, $NH_2C_6H_4N(H)(C_2H_5).H_2SO_4$, obtained by the reaction based on British Pat. No. 778,437 (1957) was granulated in the same manner as described in Example 3 to obtain 9.5 Kg of the granulated product (100 g of hydroxypropylmethyl cellulose was used in place of methyl cellulose).

| | Before Granulation | | After Granulation | |
|---|---|---|---|---|
| Solubility | 60 sec. | | 40 sec. | |
| Solidifying Property with the Lapse of Time | Solidified in 10 days | | Not solidified for 3 months | |
| Moistening Property | Before Leaving | After Leaving | Before Leaving | After Leaving |
| | 2.5% | 7.0% | 2.0% | 6.0% |
| Oxidizability | Discolored to reddish-brown | | Remained white without discoloration | |
| Crushing Weight | | | 240 g | |

EXAMPLE 8

10 Kg of the dried powdery product of 4-amino-N-ethylaniline monosulfate, $NH_2C_6H_4N(H)(C_2H_5).H_2SO_4$, obtained by the reaction based on British Pat. No. 778,437 (1957) was granulated in the same manner as described in Example 1 except that 800 g of ethyl alcohol was used as an excipient to obtain 9.5 Kg of the granulated product.

| | Before Granulation | | After Granulation | |
|---|---|---|---|---|
| Solubility | 60 sec. | | 45 sec. | |
| Solidifying Property with the Lapse of Time | Solidified in 7 days | | Not solidified for 3 months | |
| Oxidizability | Discolored to reddish-brown | | Remained white without discoloration | |
| Moistening Property | Before Leaving | After Leaving | Before Leaving | After Leaving |
| | 3.0% | 8.0% | 3.0% | 7.0% |

-continued

| | Before Granulation | After Granulation |
|---|---|---|
| Crushing Weight | | 130 g |

EXAMPLE 9

10 Kg of the dried powdery product of 4-amino-3-methyl-N-ethyl-N-(beta-hydroxyethyl)-aniline monosulfate, $NH_2C_6H_3CH_3N(H)(CH_2)_2OH.H_2SO_4$, obtained by the reaction based on the description in J. Am. Chem. Soc., Vol. 73, pp. 3100 – 3125 (1951) was granulated in the same manner as described in Example 8 except that 600 g of water was used as an excipient to obtain 9.6 Kg of the granulated product.

Crushing weight: 120 g; Solubility: 60 sec (before granulation), 40 sec (after granulation); Solidifying property with the lapse of time: the granulated product did not solidify after 3 months.

EXAMPLE 10

10 Kg of the dried powdery product of 4-amino-N-ethyl-N-(beta-methylsulfonamidoethyl)aniline monosulfate, $NH_2C_6H_4N(C_2H_5)(CH_2)_2NHSO_2CH_3.H_2SO_4$, obtained according to the process described in J. Am. Chem. Soc., Vol. 73, pp. 2100 – 3125 (1951) was granulated in the same manner as described in Example 1 to obtain 9.5 Kg of the granulated product.

| | Before Granulation | | After Granulation | |
|---|---|---|---|---|
| Solubility | 70 sec | | 40 sec | |
| Solidifying Property with the Lapse of Time | Solidified in 5 days | | Not solidified for 3 months | |
| Oxidizability | Discolored to reddish-brown | | Remained white without discoloration | |
| Moistening Property | Before Leaving | After Leaving | Before Leaving | After Leaving |
| | 3.5% | 6.0% | 3.0% | 5.0% |
| Crushing Weight | | | 150 g | |

While the invention has been described in detail and with reference to specific embodiments thereof, it will be apparent to one skilled in the art that various changes and modification can be made therein without departing from the spirit and scope thereof.

What is claimed is:

1. A granular color developing composition consisting essentially of granules which comprise p-phenylenediamine color developing agent, wherein said granules will not pass through a 250$\mu$ sieve and are dust-free and free-flowing, wherein said granular color developing composition is formed by a process which comprises:

a. mixing and kneading at least one excipient selected from the group consisting of water and lower alcohols and a p-phenylenediamine color developing agent;

b. extruding the resulting mixture to mold said mixture into a rod; and c. drying the resulting extrudate to remove the excipient.

2. A granular color developing composition according to claim 1, wherein said composition will pass through a 1680$\mu$ sieve.

3. A granular color developing composition according to claim 1, wherein said p-phenylenediamine color developing agent is a member of the group consisting of 4-amino-3-methyl-N-ethyl-N-[(beta-methanesulfonamido)-ethyl]aniline sesquisulfate monohydrate, 4-amino-N,N-diethylaniline monosulfate monohydrate, 4-amino-N-ethyl-N-(beta-hydroxyethyl)aniline monosulfate, 4-amino-N-ethylaniline monosulfate, 4-amino-3-methyl-N-ethyl-N-(beta-hydroxyethyl)aniline monosulfate, and 4-amino-N-ethyl-N-(beta-methylsulfonamidoethyl)aniline monosulfate.

4. A granular color developing composition consisting essentially of granules which comprise a p-phenylenediamine color developing agent and an alkylcellulose in admixture with said agent in an amount of from about 50 to 100 grams/10 kilograms of said color developing agent, wherein said granules will not pass through a 250$\mu$ sieve and are dust-free and free-flowing.

5. A granular color developing composition according to claim 4, wherein said alkyl cellulose is selected from the group consisting of methyl cellulose, ethyl cellulose and propyl cellulose.

* * * * *